United States Patent [19]

Coenen et al.

[11] 4,446,921

[45] May 8, 1984

[54] METHOD FOR UNDERGROUND GASIFICATION OF SOLID FUELS

[75] Inventors: Hubert Coenen; Ernst Kriegel, both of Essen, Fed. Rep. of Germany

[73] Assignee: FRIED. Krupp Gesellschaft mit beschränkter Haftung, Essen, Fed. Rep. of Germany

[21] Appl. No.: 359,171

[22] Filed: Mar. 16, 1982

[30] Foreign Application Priority Data

Mar. 21, 1981 [DE] Fed. Rep. of Germany ..... 3111137

[51] Int. Cl.[3] ..... E21B 43/22; E21B 43/24; E21B 43/40

[52] U.S. Cl. ..... 166/267; 166/259; 166/261; 166/266; 166/271; 166/272

[58] Field of Search ..... 166/259, 261, 266, 267, 166/271, 272, 303, 304, 307; 48/DIG. 6

[56] References Cited

U.S. PATENT DOCUMENTS

| | | | |
|---|---|---|---|
| 2,355,167 | 8/1944 | Keith | 166/267 X |
| 2,906,337 | 9/1959 | Hennig | 166/261 |
| 2,974,937 | 3/1961 | Kiel | 166/272 X |
| 3,241,611 | 3/1966 | Dougan | 166/266 X |
| 3,358,756 | 12/1967 | Vogel | 166/266 |
| 3,480,082 | 11/1969 | Gilliland | 166/266 |
| 3,516,495 | 6/1970 | Patton | 166/272 |
| 4,010,800 | 3/1977 | Terry | 166/272 X |
| 4,299,285 | 11/1981 | Tsai et al. | 166/259 |

FOREIGN PATENT DOCUMENTS 1493190 1/1973 Fed. Rep. of Germany .

*Primary Examiner*—George A. Suchfield
*Attorney, Agent, or Firm*—Spencer & Frank

[57] ABSTRACT

Method for the underground gasification of solid fuels in which an underground fuel deposit is initially opened up and then converted into a gaseous fuel by means of a gasification medium. The opening of the fuel deposit is effected by treatment with a gas which is in the supercritical state, which takes on the volatile organic substances of the solid fuel and the water contained in the solid fuel. The dissolved organic compounds and the water are separated from the charged supercritical gas phase above ground in at least two fractions by pressure reduction and/or a change in temperature.

5 Claims, 1 Drawing Figure

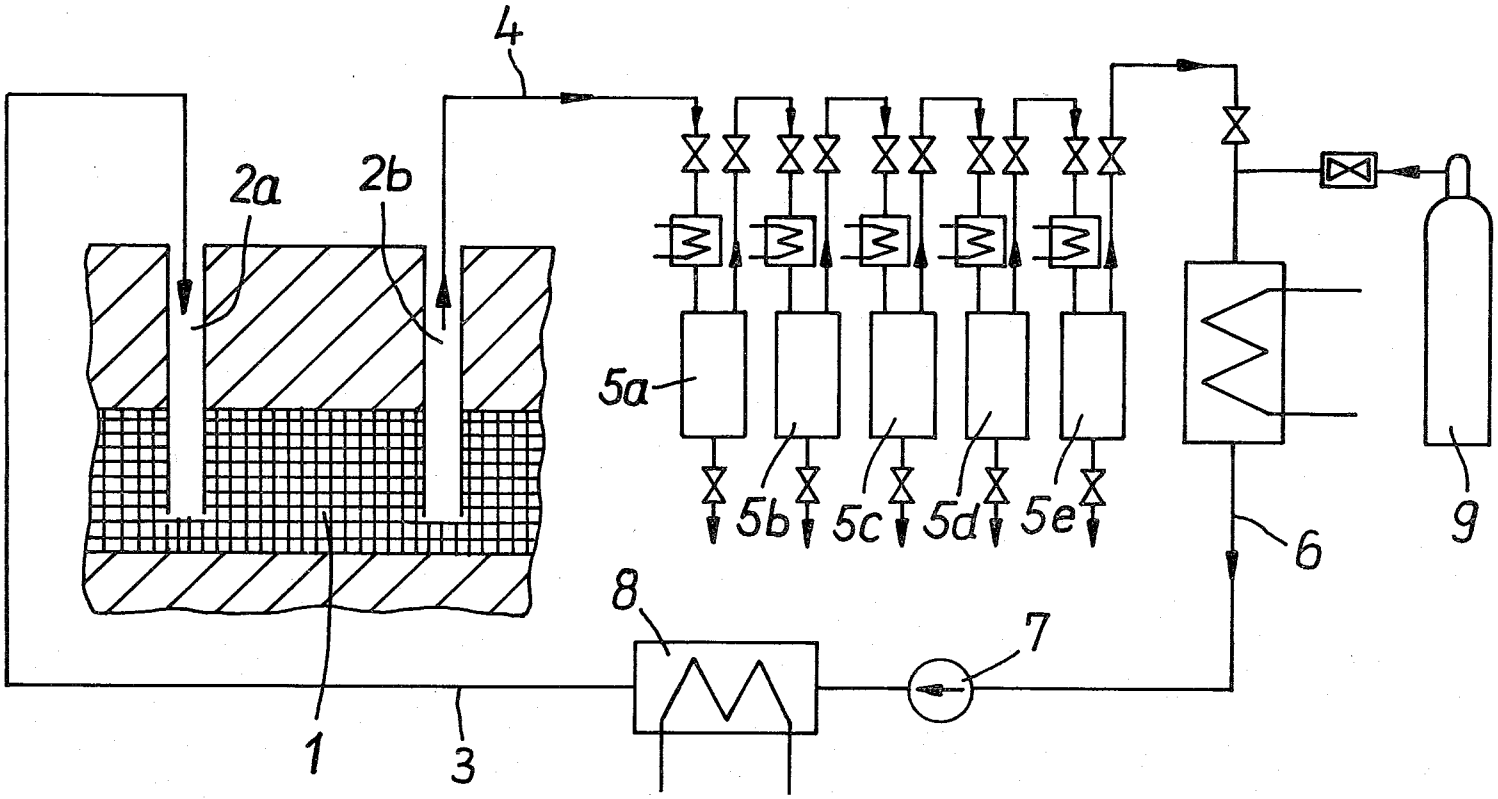
9
6
5e
5d
5c
5b
5a
7
8
4
3
2b
2a
1

METHOD FOR UNDERGROUND GASIFICATION OF SOLID FUELS

BACKGROUND OF THE INVENTION

The present invention relates to a method for the underground gasification of solid fuels in which the underground fuel is initially opened up and then converted into a gaseous fuel by means of a chemical reaction with a gasification medium.

It is known that solid fuels, particularly coal, can be gasified at the location where they exist so that mechanical conveyance of the fuel becomes superfluous and less minable fuel deposits can be utilized. In the known underground gasification processes, bore holes are drilled from the earth's surface down to the location of the fuel deposits. Through these bore holes the fuel deposit is opened up by means of a suitable process in order to increase the gas permeability of the fuel which already exists to a greater or lesser degree. Thereafter, the gasification medium is introduced into the opened up fuel deposit through one or a plurality of bore holes and the gasification reaction is started by ignition. Air, oxygen enriched air or air mixed with water vapor can be used as the gasification medium. Underground gasification involves the known gasification reactions listed below:

$C+O_2=CO_2+97.0$ kcal $C+\frac{1}{2}O_2=CO+29.3$ kcal $C+CO_2=2CO-38.4$ kcal $CO+\frac{1}{2}O_2=CO_2+68.2$ kcal $C+H_2O=CO+H_2-28.3$ kcal $CO+H_2O=CO_2+H_2+10.11$ kcal The gas produced during the underground gasification has a heat value, if 60% oxygen and 40% hydrogen are used as a gasification medium, of about 1350 kcal/Nm$^3$. This gas is transported out of the fuel deposit through the bore holes and can be utilized as heating gas or, after suitable pretreatment, as synthesis gas.

The opening up of the fuel deposit before the actual underground gasification is necessary to make the fuel deposit sufficiently permeable for the gasification medium and for the resulting gas produced by the gasification. The following known opening up processes have been used for the opening up of the fuel deposit:

(1) The resistance process: in this process electrodes are introduced into the bore holes and a current is applied to the electrodes to heat the fuel deposit and create coked zones in the fuel which are permeable for gases.

(2) The channel combustion process: in this process channels are burnt into the fuel deposit.

(3) Hydraulic bore hole treatment: in this process cracks are formed in the fuel deposit by fluids that are pressed in.

(4) Direct drilling: in this process, bore holes which branch out from the vertical bore holes are driven into the fuel deposit until they reach the next vertical bore hole. Thereafter, the branch bore hole can be widened by burning.

The known opening up processes suffer from the drawback that the volatile organic components in particular, which are present in the solid fuels, cannot be removed. As a result, during the actual underground gasification, the volatile components are driven out of the gasified section of the fuel deposit and clog up the gas permeable pores and cracks existing in the adjacent section of the fuel deposit. Moreover, the water present in the solid fuel is not removed by the prior art opening up processes, with the result that the heating value of the gas generated by the underground gasification is reduced correspondingly.

German Auslegeschrift DE-AS No. 1,493,190 discloses a method for separating mixtures of organic substances by treating the mixtures of organic substances with supercritical gas and subsequently separating the substances dissolved in the resulting supercritical gas phase by reduction of pressure and/or increase in temperature. This publication does not contain any disclosure relating to opening up solid fuel deposits underground by using supercritical gases. Moreover, this publication does not suggest the use of supercritical gas for the underground gasification of solid fuels as an opening up agent, since it could not be expected that particularly the volatile organic compounds could be extracted from the solid fuel in an advantageous manner while still underground and then recovered above ground.

SUMMARY OF THE PRESENT INVENTION

It is an object of the present invention to provide a process for the underground gasification of solid fuels in which the volatile components existing in the solid fuel can be recovered and which furnishes a gas having a high heat value.

It is a further object of the present invention to improve the control and economy of underground gasification.

Additional objects and advantages of the present invention will be set forth in part in the description which follows and in part will be obvious from the description or can be learned by practice of the invention. The objects and advantages are achieved by means of the processes, instrumentalities and combinations particularly pointed out in the appended claims.

To achieve the foregoing objects and in accordance with its purpose, the present invention provides a process for underground gasification of a solid fuel, in which the solid fuel, which is present under the earth's surface, is initially opened up and then converted into a gaseous fuel by means of a chemical reaction with a gasification medium, comprising opening up the solid fuel underground by treating the solid fuel with a gas which is in the supercritical state to dissolve the volatile organic compounds and water contained in the solid fuel in the supercritical gas and thereby form a charged supercritical gas phase, and separating the dissolved organic compounds and the dissolved water from the charged supercritical gas phase above ground in at least two fractions by pressure reduction and/or a change in temperature.

It is to be understood that both the foregoing general description and the following detailed description are exemplary, but are not restrictive of the invention.

BRIEF DESCRIPTION OF THE DRAWINGS

The sole drawing FIGURE is a schematic illustration showing a system for practicing the present invention.

DETAILED DESCRIPTION OF THE INVENTION

The process of the present invention for underground gasification of a solid fuel, in which the solid fuel, which is present under the earth's surface, is initially opened up the then converted into a gaseous fuel by means of a chemical reaction with a gasification medium, comprises opening up the solid fuel underground by treating the solid fuel with a gas which is in the supercritical state to dissolve volatile organic compounds and water contained in the solid fuel in the supercritical gas and thereby form a charged supercritical gas phase, and separating the dissolved organic compounds and the dissolved water from the charged supercritical gas phase above ground in at least two fractions by pressure reduction and/or a change in temperature.

The process of the present invention presents numerous advantages. By extracting the volatile components from the solid fuel by the supercritical gas before the gasification process, the volatile components are prevented from clogging the gas permeable pores of the solid fuel during the gasification process and thus they do not have an adverse influence on the gas permeability of the solid fuel. It is an additional advantage of the present invention that the water present in the fuel is substantially taken up by the supercritical gas so that the heat value of the gas generated during the underground gasification is increased correspondingly. Moreover, the fractionated separation of the gaseous and liquid organic compounds and of the water from that fuel according to the present invention permits the recovery of raw material, particularly aromatic hydrocarbons, in an advantageous manner.

Coal deposits for which mining does not seem worthwhile and which, in particular, do not contain water laden layers are particularly suitable for underground gasification in accordance with the present invention. However, the process of the present invention can also be used for oil shale and oil sand deposits if geological conditions permit. Prerequisite for the usability of the process according to the present invention is a dense deposit from which the charged supercritical gas phase can be recovered almost completely.

According to the present invention, it is a particular advantage, if the gas, which is in the supercritical state, enters the fuel deposit at a temperature from 10° to 100° C. above its supercritical temperature and a pressure of 2 to 300 bar above its critical pressure. The use of these conditions assures that the gas, on the one hand, retains its supercritical state while in the fuel deposit and, on the other hand, is introduced into the fuel deposit with an economically justifiable amount of energy consumption.

Preferably, in the practice of the process according to the present invention, the temperature of the supercritical gas drops on its path of extraction from the fuel deposit in such a manner that, when the gas leaves the fuel deposit it has a temperature which is 5° to 15° C. above its supercritical temperature. This measure ensures that the supercritical gas is continuously charged with a larger quantity of extracted compounds while on its extraction path, since the dissolving capability of supercritical gases generally is at an optimum in a temperature range which is slightly above the critical temperature and decreases with increasing temperature. By providing a temperature gradient for the supercritical gas underground as just described, that is, by having the temperature of the supercritical gas drop during its passage through the fuel deposit, the extracted substances are prevented from precipitating before the supercritical gas phase leaves the fuel deposit and thus will not clog the gas permeable pores of the fuel.

Preferably, in the practice of the present invention, the entering temperature of the supercritical gas into the fuel deposit is lowered during the course of the opening-up process by 2° to 50° C. Thus, as the opening up process progresses, the temperature at which the supercritical gas is fed into the fuel deposit is lowered in stages or continuously. By lowering the entering the temperature of the supercritical gas, the extraction capability of the supercritical gas during opening up of the fuel deposit is continuously increased, and any reduction in the extraction rate caused by the decrease in the quantity of substances to be extracted during the opening up process can be compensated by the increase in the dissolving capability of the supercritical gas. Due to the fact that the temperature of the supercritical gas when it enters the fuel deposit is lowered during the opening up process and that the exit temperature of the supercritical gas when it leaves the fuel deposit preferably is only slightly above (e.g., 5° to 15° C. above) the critical temperature of the gas, the zone within which the supercritical gas has the maximum extraction effect advantageously travels oppositely to the direction of flow of the supercritical gas.

The process according to the present invention can be practiced with particular success if $CO_2$ is used as the supercritical gas to open up the solid fuel, since supercritical $CO_2$ has a sufficiently good dissolving capability for water as well as for the organic compounds contained in the solid fuel and can be used without costly safety precautions. Moreover, $CO_2$ has a critical pressure of $p_{crit}=73.9$ bar and a critical temperature of $T_{crit}=31°$ C. which appears to make it economically appropriate for use for the opening up of underground coal deposits for underground gasification, particularly since many such fuel deposits have a temperature which is above the critical temperature of $CO_2$. Although $CO_2$ is preferably used for the opening up, ethane, ethene, propane or mixtures of these gases can be used for the opening up of the fuel. When such gases are used to practice the present invention, however, care must be taken to avoid safety risks, e.g. by explosion-proof devices.

After the supercritical gas phase passes through the fuel deposit, it contains volatile organic compounds and water, and is brougth above ground where the dissolved organic compounds and water are separated from the charged supercritical gas. The separation of the dissolved substances from the gaseous phase according to the present invention can be effected merely by reducing the pressure or merely by changing the temperature (termperature increase or temperature reduction) of the gas phase or by simultaneously reducing the pressure and changing the temperature (temperature increase or temperature reduction) of the gas phase. The separation from the gas phase is performed in at least two stages to obtain at least two fractions of the extracted substances.

Turning now to the drawing, there is shown a coal deposit 1 in which two vertical bore holes 2*a* and 2*b* are made. Supercritical $CO_2$ is employed for the opening up, and is conducted through a gas line 3 into coal deposit 1 through bore hole 2*a*. Instead of supercritical $CO_2$, supercritical propane, ethane, ethene or mixtures of these gaseous hydrocarbons can also be used, but it must then be assured that the use of these gases does not create safety risks.

The supercritical $CO_2$ has a temperature of about 60° C. and a pressure of about 300 bar when it enters into coal deposit 1. The supercritical $CO_2$ diffuses through coal deposit 1, and thereby charges itself with volatile organic compounds and with water to form a charged supercritical gas phase 4. The water content of coal is about 1 percent by weight on the average, and this water is generally taken up by the supercritical gas phase since it charges itself with water until it is saturated. The water from fuel layers which contain or carry much water is extracted only partly by the supercritical gas phase. The longer the opening-up of the coal deposit 1 is continued, the more diffusion channels are created so that a high permeability of coal deposit 1 for gases is obtained. A suitable range for the length of time for the opening up process lays between some hours and some days and depends on the respective extraction conditions.

The charged supercritical gas phase 4 exits from bore hole 2*b* and is separated into its components. The ratio of supercritical gas quantity to oepned up coal quantity is between 3:1 and 10:1, which is a weight ratio.

In order to separate the charged supercritical gas phase, it is passed in succession through five fractionating devices 5*a*, 5*b*, 5*c*, 5*d*, and 5*e*. In these fractionating devices, the dissolved organic compounds are separated in a known manner from the supercritical $CO_2$ according to their molecular weight, as is the dissolved water, by way of pressure reduction and/or a change in temperature. The resulting regenerated opening up medium 6 is compressed in a pump 7 to the supercritical pressure required to open up coal deposit 1, and is heated to the required supercritical temperature in a heat exchanger 8. It then is conveyed in its supercritical state into bore hole 2*a*. Since a certain quantity of the opening up medium is lost during the opening up, new gas, in the present case, $CO_2$, is continuously added from a reservoir tank 9 to the circulation.

In laboratory tests, it has been found that a supercritical gas phase consisting of hydrocarbons takes on up to 50 percent by weight of the extracted coal. The extract recovered from the supercritical gas phase consists of very volatile, medium volatile and difficulty volatile organic compounds and small quantities of water. Hydration of the extract furnished the following products:

paraffins: 15%
cycloparaffins: 34%
alkyl benzenes: 34%
higher aromatic hydrocarbons: 10%
remainder: 7%

"50 percent by weight of the extracted coal" means that for every 100 grams of coal deposit, 50 grams of volatiles and water can be extracted. The very volatile, medium volatile and difficulty volatile organic compounds form the different fractions which can be in a gaseous or liquid state like fractions of the well known petroleum distillation. As dense deposit remains a coke-like product which has only little portions of volatiles. The flow rate of the supercritical gas depends on the ratio of the supercritical gas to opened up coal quantity and on the coal quantity itself. The size of the bore holes and their respective distance between them depends on the nature of the coal deposit.

It will be understood that the above description of the present invention is susceptible to various modifications, changes and adaptations, and the same are intended to be comprehended within the meaning and range of equivalents of the appended claims.

What is claimed is:

1. In a process for underground gasification of a solid fuel in which the solid fuel, which is present under the earth's surface, is initially opened up and then converted into a gaseous fuel by means of a chemical reaction with a gasification medium, the improvement comprising: opening up the solid fuel underground by treating the solid fuel with a gas which is in the supercritical state to dissolve the volatile organic compounds and water contained in the solid fuel in the supercritical gas and form a charged supercritical gas phase, the gas which is in the supercritical state having a temperature of 10° to 100° C. above its critical temperature and a pressure of 2 to 300 bar above its critical pressure when it enters the fuel deposit, and separating the dissolved organic compounds and the dissolved water from the charged supercritical gas phase above ground in at least two fractions by pressure reduction and/or a change in temperature.

2. Process as defined in claim 1 wherein the temperature of the supercritical gas decreases on its extraction path underground to such an extent that, when the gas exists from the fuel deposit it has a temperature which is 5° to 15° C. above its critical temperature.

3. Process as defined in claim 1 wherein the entrance temperature of the supercritical gas into the fuel deposit is lowered by 2° to 50° C. during the opening up process.

4. Process as defined in claim 1 wherein the supercritical gas is $CO_2$.

5. Process as defined in claims 1 wherein the supercritical gas is ethane, ethene, propane or a mixture of these gases.

* * * * *